US006430757B1

(12) United States Patent
Pohler

(10) Patent No.: US 6,430,757 B1
(45) Date of Patent: Aug. 13, 2002

(54) SELF-CONTAINED TOILET BASIN

(75) Inventor: Donald M Pohler, Rochester, NY (US)

(73) Assignee: Liberty Pumps Inc., Bergen, NY (US)

( * ) Notice: Subject to any disclaimer, the term of this patent is extended or adjusted under 35 U.S.C. 154(b) by 0 days.

(21) Appl. No.: 09/553,786

(22) Filed: Apr. 21, 2000

(51) Int. Cl.[7] ..... E03D 1/00
(52) U.S. Cl. ..... 4/321
(58) Field of Search ..... 4/321–323; 220/254, 220/367.1

(56) References Cited

U.S. PATENT DOCUMENTS

| | | | | | |
|---|---|---|---|---|---|
| 3,570,018 | A | * | 3/1971 | Sargent et al. | 4/323 |
| 3,582,995 | A | * | 6/1971 | Enenstein | 4/321 |
| 3,597,768 | A | * | 8/1971 | Wofford | 4/323 |
| 4,377,875 | A | | 3/1983 | Brubakken | |
| 4,653,128 | A | | 3/1987 | Canalizo | |
| 4,704,747 | A | | 11/1987 | Brubakken et al. | |
| 4,947,491 | A | * | 8/1990 | Parkinson et al. | 4/321 |
| 5,038,418 | A | | 8/1991 | Frey | |
| 5,983,411 | A | * | 11/1999 | Demoret | 4/363 |
| 6,038,710 | A | * | 3/2000 | Baron | 4/321 |
| 6,129,117 | A | * | 10/2000 | Eriksson | 4/321 |

OTHER PUBLICATIONS www.plumbing.com/sewagesystems.html, accessed May 16, 2001, showing Liberty Pumps'"LowPro Sewage System" and Zoeller's Qwik Jon, accessed May 16, 2001.*

* cited by examiner

*Primary Examiner*—Charles R. Eloshway
(74) *Attorney, Agent, or Firm*—Brian B. Shaw, Esq.; Stephen B. Salai, Esq.; Harter, Secrest & Emery LLP

(57) ABSTRACT

A self-contained bathroom waste collection and disposal unit, having an access cover free of electrical and plumbing fixtures is disclosed. The unit includes a reservoir having an inlet and a sump opening. The sump opening is sized to receive a pump and a float mechanism therethrough. The sump opening is closed by a primary cover having venting, plumbing and electrical ports and an access cover. The access cover can be removed to access the enclosed sump, without interrupting the venting, plumbing or electrical connections.

11 Claims, 6 Drawing Sheets

44
100
102
116
66
62
64
90
124
46
66
70
92
94
46
42
52
40
144
110
108
106
48

SELF-CONTAINED TOILET BASIN

FIELD OF THE INVENTION

The present invention relates to self-contained bathroom waste collection and disposal units, and more particularly, to refuse tanks for such units.

BACKGROUND OF THE INVENTION

Self-contained bathroom waste collection and disposal units have particular utility for constructing bathrooms in locations not originally outfitted for such bathrooms. For example, such units are often used in the construction of bathrooms in an existing basement or on a concrete slab.

The refuse tanks must be made of a non-corrosive material, must be gas tight and water tight, and must be rigid enough to support the weight of a toilet and a person using it. Furthermore, the refuse tanks must include a reservoir for waste and a pump system to transfer the waste into a sewer or septic system.

It is sometimes necessary to gain access to the reservoir for maintenance or repair. In some instances, a problem such as clogging, the sticking of a float mechanism or the failure of an electrical switch could be simply corrected if it were possible to gain access without disturbing plumbing and electrical connections.

In prior systems access to the reservoir is gained by removing a single cover having plumbing and electrical connections attached thereto. However, interrupting these connections is time consuming and hence costly.

Therefore, a need exists to provide a refuse tank for a bathroom waste collection and disposal unit with a cover which will preclude unnecessary disturbance of the plumbing and electrical connections. There is a further need for a disposal reservoir, wherein pumping components can be easily set into an operable position, yet mechanically retained in those positions to reduce stress on plumbing and electrical connections. There is finally a need for a disposal reservoir which is lightweight and mechanically strong, yet includes handling features so that it is easily transported and installed.

SUMMARY OF THE INVENTION

The invention includes a self-contained bathroom waste collection and disposal unit having a reservoir configured to operably retain a pump and a float-operated switch. The reservoir cooperates with a primary cover having plumbing and electrical access ports, and a secondary cover free of connecting ports that is readily removed to permit convenient access to the reservoir, including the switch (e.g., to replace the switch) and the pump inlet (e.g., to remove clogs).

The invention further includes integral, molded features for retaining the switch and pump in an operable position. For example, a boss on the cover prevents displacement of the pump, and molded-in torque stops prevent rotational movement of the pump; thereby absorbing the torque of the pump as it operates and correspondingly reducing stress on plumbing joints.

The invention further includes molded-in strengthening collars and recesses sized to assist in transporting and installing the unit. A packaging box may be employed with reservoir wherein the box includes openings which align with the corresponding recesses in the reservoir.

DETAILED DESCRIPTION OF THE PREFERRED EMBODIMENTS

Figure 1:
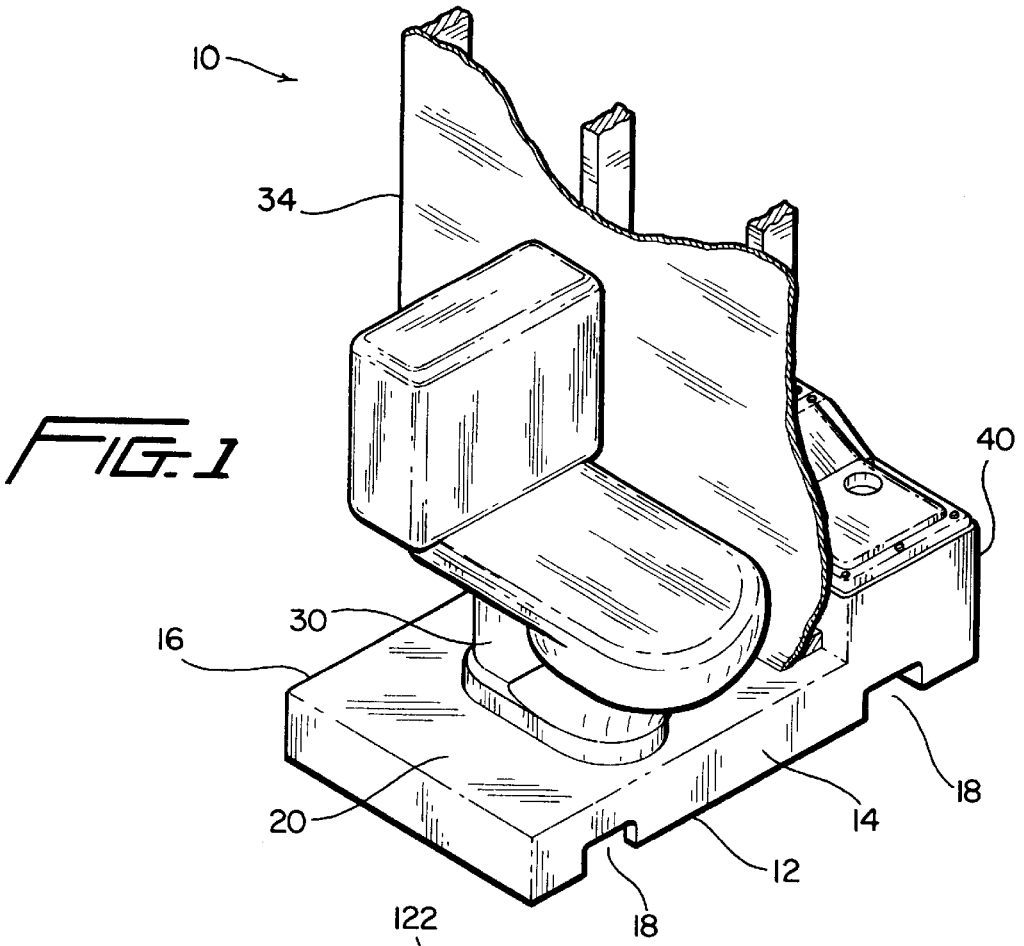
FIG. 1 is a perspective view of a self-contained bathroom waste collection and disposal unit.

Referring to FIG. 1, the invention pertains to a self-contained toilet unit 10, for the collection and disposal of bathroom waste. Typically, the unit 10 is employed in a basement or other location where a conventional system which relies on gravity to provide drainage cannot function. The unit 10 includes a substantially L-shaped reservoir 12, which has an outside front 14 and an outside rear 16. The L-shaped reservoir includes a generally horizontal portion and a vertical portion.

Figure 3:
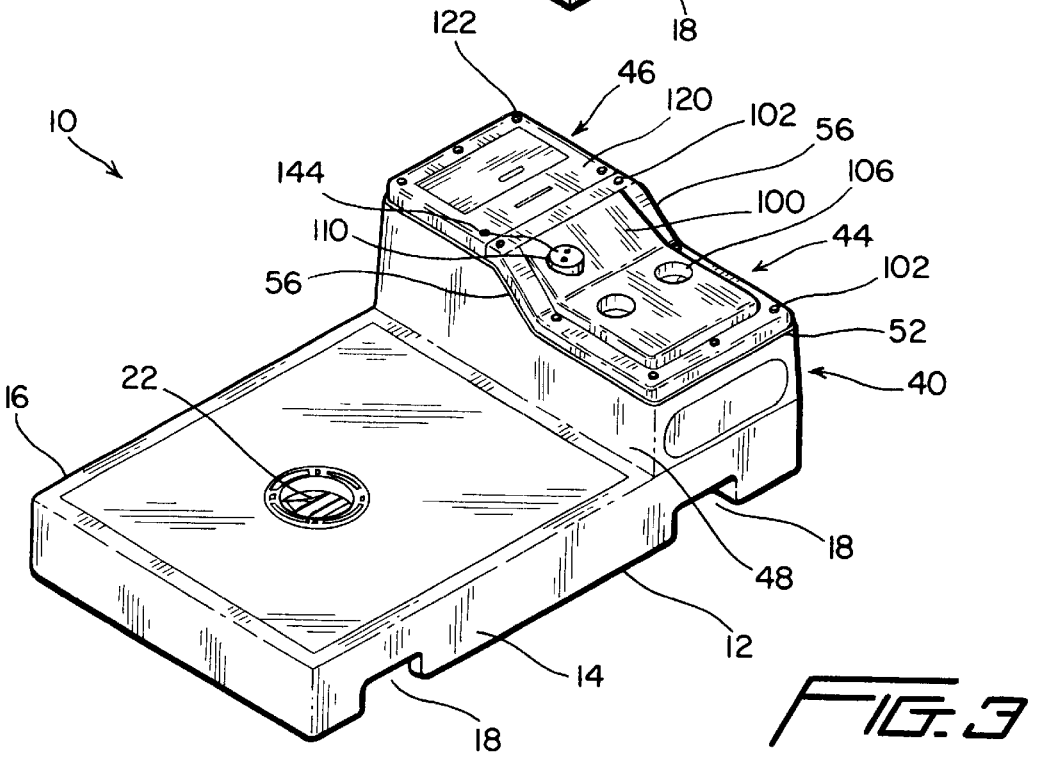
FIG. 3 is an alternative perspective view of a reservoir whereon are placed a primary and a secondary cover.
Figure 2:
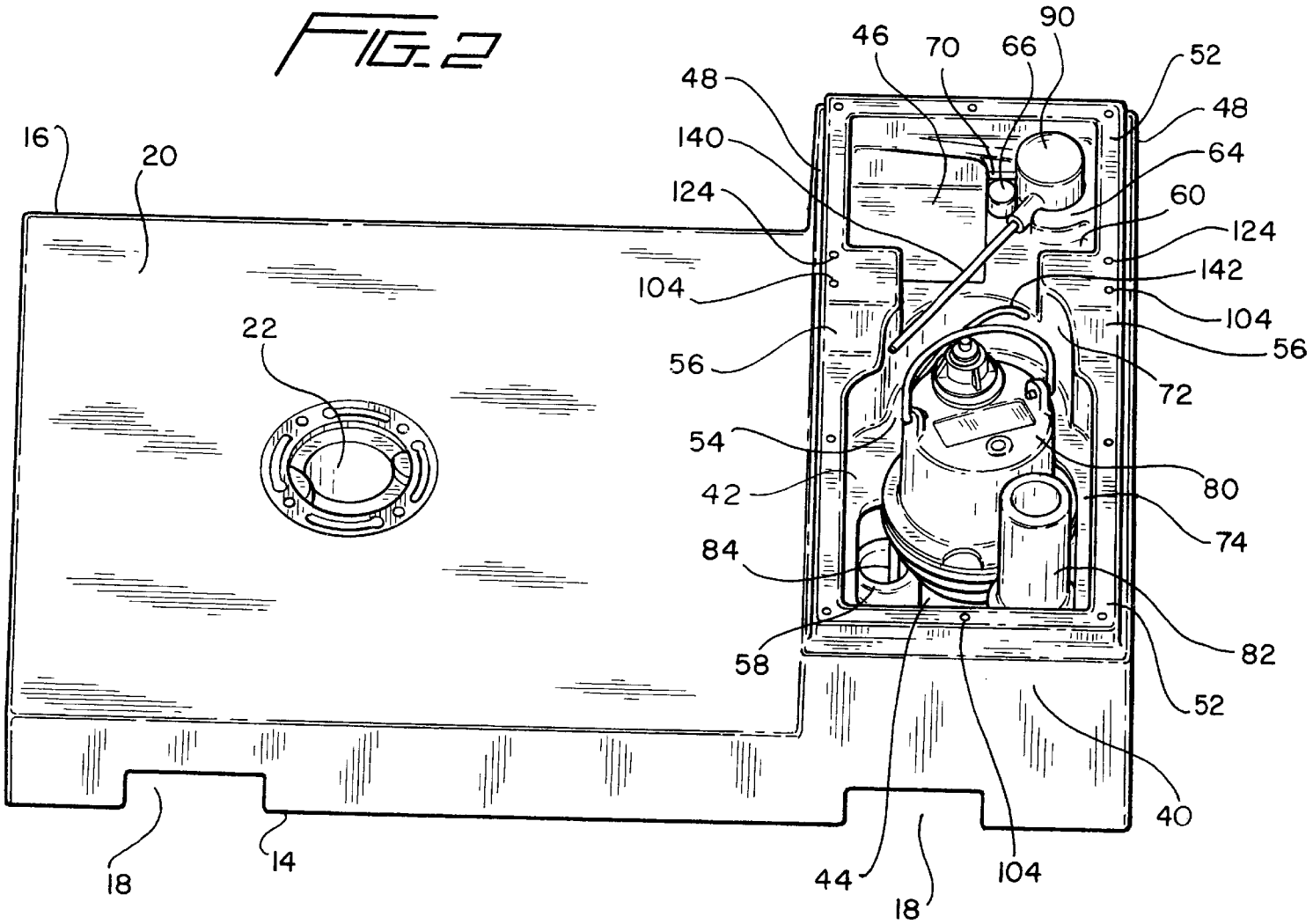
FIG. 2 is a perspective view of a reservoir
Figure 4:
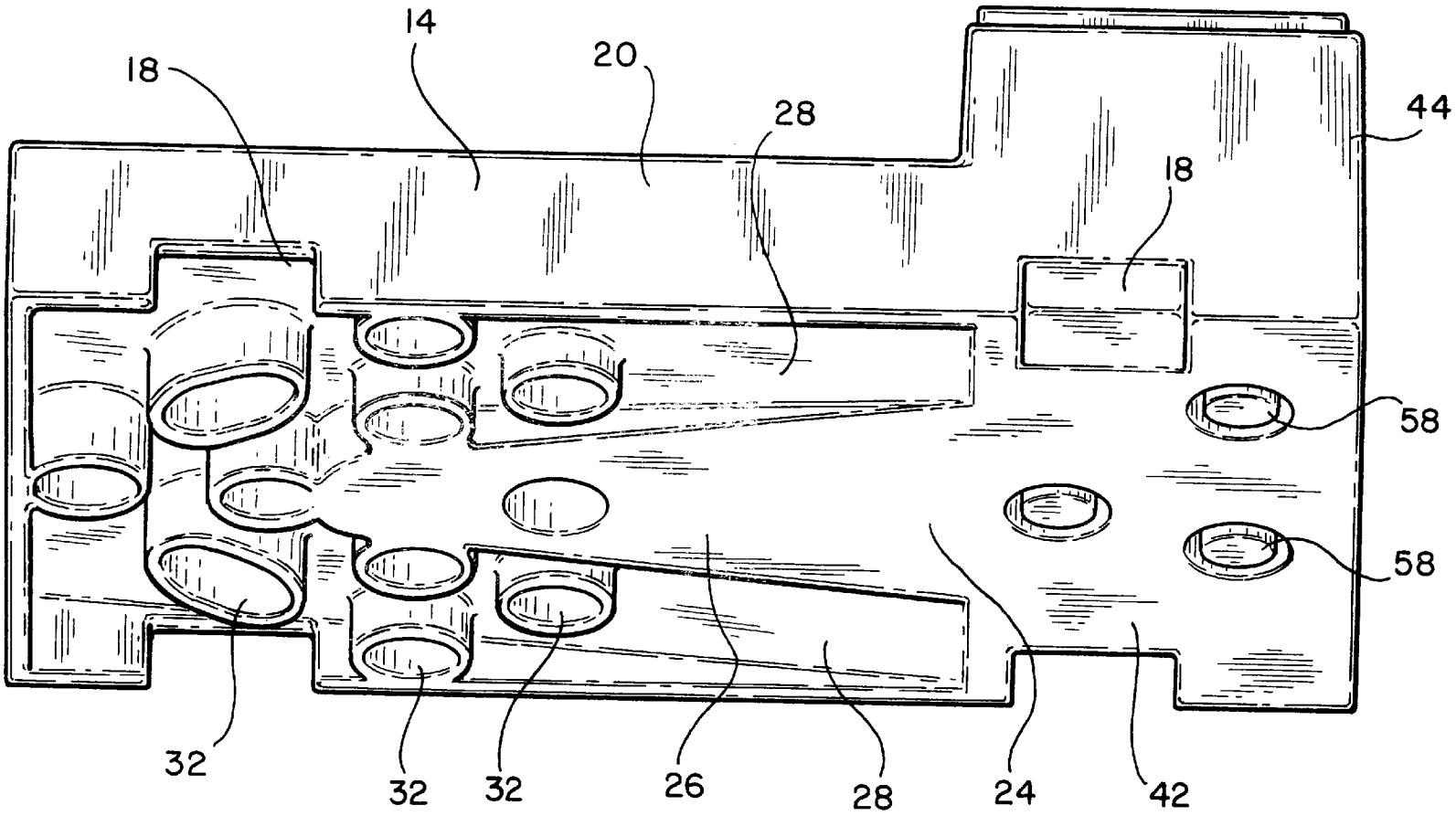
FIG. 4 is a perspective view of the reservoir as seen from below.
Figure 5:
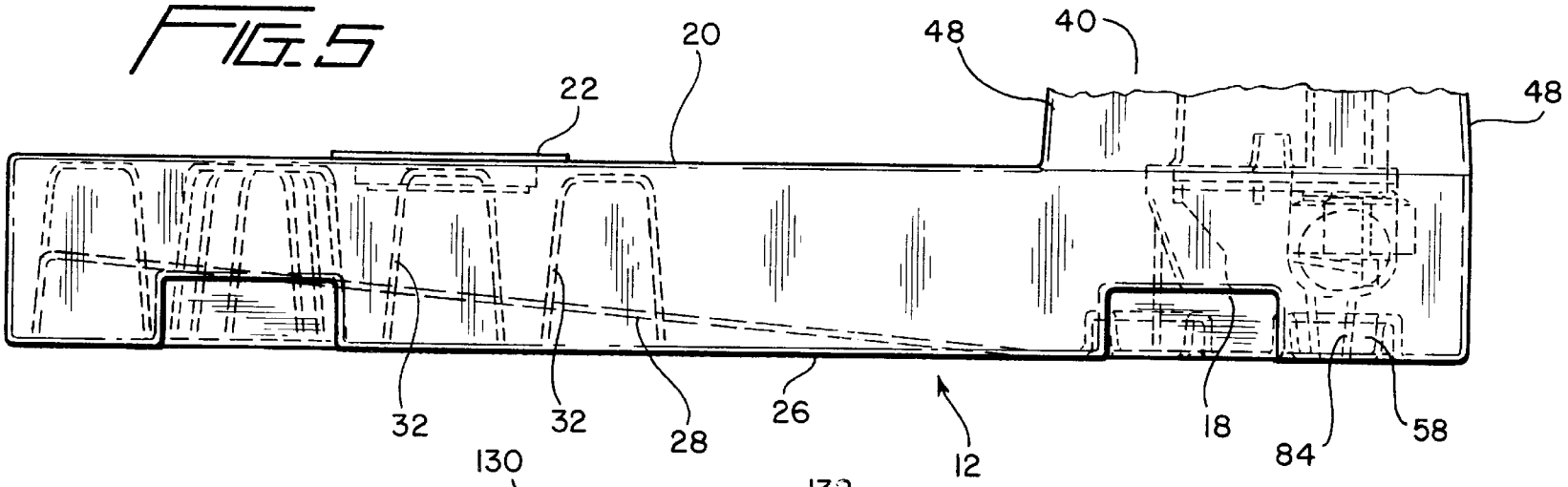
FIG. 5 is a front elevation of a portion of the reservoir.

As seen in FIGS. 2 and 3, a horizontal part of the L-shaped reservoir includes a platform area 20 which is covered except for an inlet 22, above which can be placed a toilet basin 30. The platform area 20 has a floor 24 with a flat portion 26 which extends from directly beneath the inlet 22 to a sump 40. The sump 40 has a sump floor 42 level with the flat portion 26 of the inlet floor 24. To the front and rear of the inlet 22, the inlet floor 24 has ramps 28 which slope downward on either side of the flat portion 26 until they meet the sump floor 42, as seen in FIGS. 4 and 5. As shown in FIG. 4, the platform area 20 has molded-in cylindrical reinforcing studs 32 which support the weight of the basin 30 and a user.

The vertical part of the L-shaped reservoir includes the sump 40 which has a pump compartment 44, a switch compartment 46, opposed sides 48 and a top perimeter 52. The sump 40 has a sump opening 54 sized to admit a pump 80 and a switch 90, and configured to subsequently provide access thereto. Starting from the switch compartment 46 and extending part way along the sides 48, the perimeter 52 is level and includes; inclined portions 56 which slope downward to the pump compartment 44 where the perimeter is once again level.

Optionally, a partition 34 is provided between the basin 30 and the sump 40. The unit 10 may be built-in with the partition 34 forming part of a building wall. Although the sump opening 54 and associated perimeter 52 are shown as lying in a plurality of planes, it is understood the sump opening may lie in a single plane.

The sump 40 has various integrally moulded members, as will be individually described, which provide for easily locating and accommodating the pump 80 and the switch 90.

The pump 80 includes a discharge port 82, and is supported on three legs 84. Molded into the sump floor 42 are three recesses or torque stops 58 configured to receive the legs 84. The torque stops 58 absorb rotational forces created during operation of the pump 80. Preferably, the torque stops 58 are configured to be compatible with a standard pump.

Figure 6:
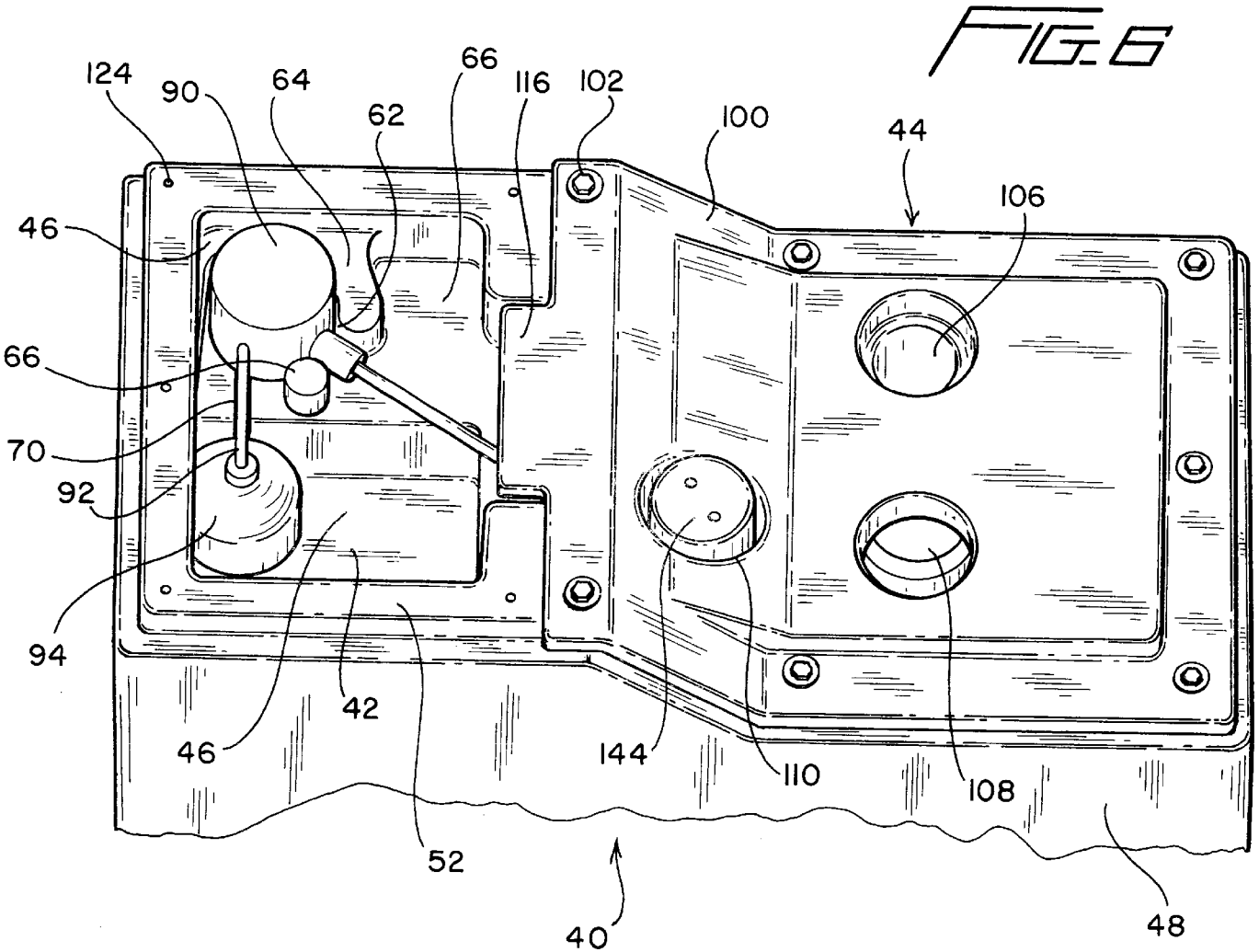
FIG. 6 is a perspective view of a sump with the primary cover in place.

As seen in FIG. 6, the switch 90 is operably connected by a connecting rod 92 to a float 94 and is actuated thereby when the waste reaches a predetermined depth. The switch 90 rests on a shelf 60 integrally molded into the reservoir 12, and is accommodated in a recess 62 that is bounded by a molded rib 64 and a stop 66. A slot 70 is provided in the shelf 60 to accommodate the connecting rod 92.

Figure 7:
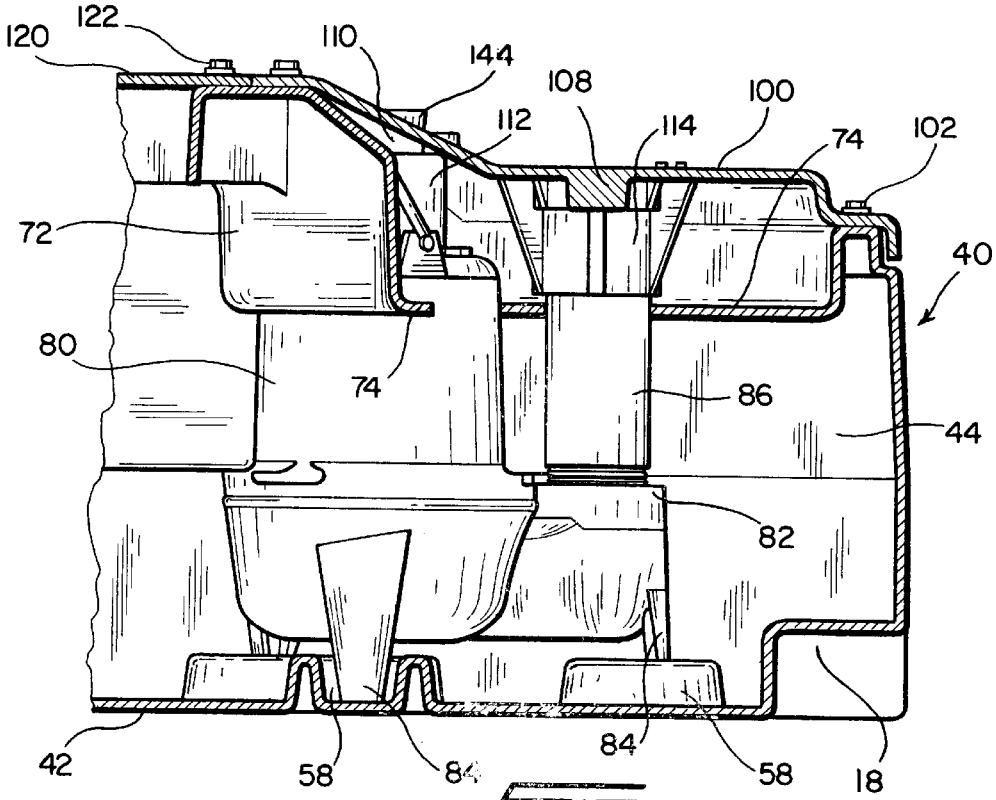
FIG. 7 shows a cross-section taken along 7—7 of FIG. 6 of a pump compartment of the sump.

The shelf 60 is contiguous with a curved wall 72 that faces the pump 80 and extends to merge with a horizontal strengthening flange 74, which is disposed around the inside of the pump compartment 44, as indicated in FIG. 7. The curved wall 72 forms a bridge between the sides 48 of the sump 40, and does not impede fluid communication between the pump compartment 44 and the switch compartment 46.

In the preferred embodiment, a primary cover 100 is sized to be removably attached at the reservoir 12 at the sump opening 54, including the inclined portions 56 thereof and the pump compartment 44, using fasteners such as screws 102 which engage with primary fastening points 104. The primary cover 100 has a threaded discharge or plumbing port 106, a threaded venting port 108 and an electrical port 110. The primary cover 100 also has a depending boss 112. Preferably, a tubular extension 114 concentric with the plumbing port 106 extends beneath the underside of the primary cover 100.

A secondary cover 120 is sized to be removably attached to the reservoir 12 adjacent to the switch compartment 46, by fasteners such as screws 122 which engage with fastening points 124. When both covers are in place, in a preferred configuration the secondary cover 120 overlaps a protruding portion 116 of the primary cover 100. The primary cover 100 provides the electrical, plumbing and venting interface with the unit 10, while the secondary cover 120 is free of interface structures. The secondary cover 120 can thereby be readily removed from the reservoir 12 to provide access to the sump, the pump and the float switch without disconnecting electrical, plumbing or venting lines from the unit.

Figure 9:
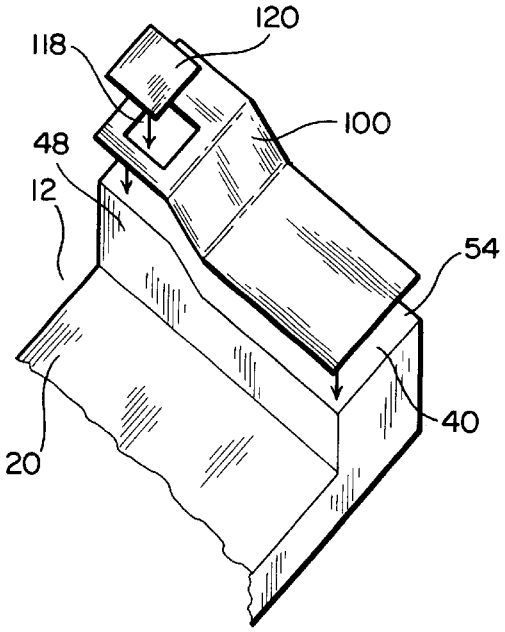
FIG. 9 is an exploded schematic of another embodiment showing the covers and a portion of the reservoir.
Figure 10:
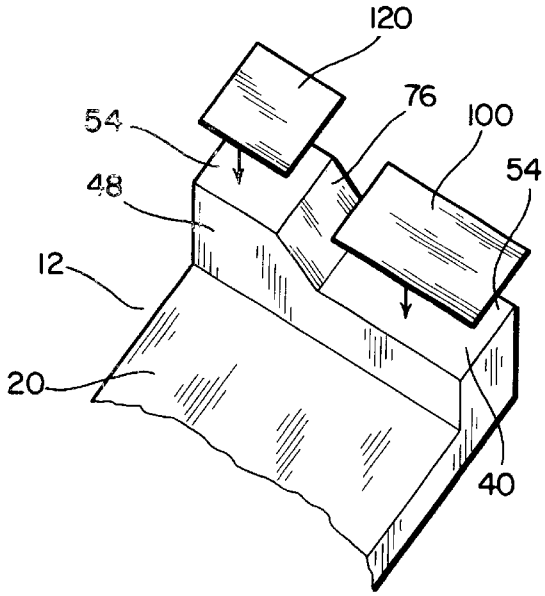
FIG. 10 is an exploded schematic of yet another embodiment showing the covers and a portion of the reservoir.

The primary and secondary covers 100, 120 have been specified in terms of a particular spatial relationship with each other, but other configurations are possible. For example, the secondary cover 120 may be located at one corner of the switch compartment 46, with the primary cover 100 occupying the remainder of the sump opening 54. Another embodiment of the invention, illustrated in FIG. 9, has the primary cover 100 covering the entire sump 40, and the secondary cover 120 placed over an access opening 118 which is entirely bounded by the primary cover 100. In yet another embodiment shown in FIG. 10, the sump opening 54 may be divided by a bridging member 76, the primary and secondary covers 100 and 120 being attached to the reservoir 12 on opposite sides of the bridging member 76.

Figure 8:
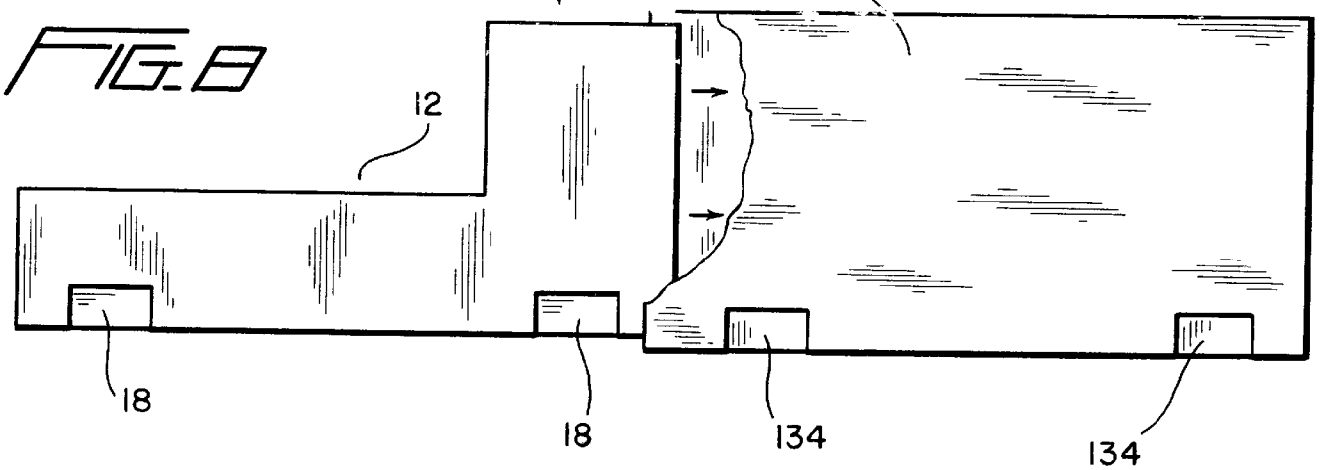
FIG. 8 is a side elevation of a package including the housing and a container.

The reservoir 12 is handled and installed as follows. The reservoir 12 is typically received as part of a package 130 which includes a packing container 132 with openings 134, as illustrated in FIG. 8. Preferably, the primary and secondary covers 100 and 120 are included in the package 130. When the reservoir 12 is fully inserted into its container 132, two pairs of opposed recessed handles 18 in the outside front 14 and the outside rear 16 of the reservoir 12 align with the container openings 134, facilitating mechanical and manual handling. The reservoir 12 is removed from the packing container 132 and placed in its desired location with appropriate plumbing and electrical services available.

The basin 30 is positioned, affixed and sealed above the inlet 22 in the same manner as a conventional installation is secured to a floor, and connected to a water supply in the normal manner. The pump 80 is lowered into position so that each of its legs 84 is received by one of the torque stops 58. It is oriented so that the discharge port 82, which includes an upwardly directed discharge pipe 86, is aligned with the intended location of the discharge opening 106.

The switch 90 is placed in the locating recess 62 so that it rests on the shelf 60, with the connecting rod 92 passing downward through a slot 70 and terminating at the float 94. An electrical connection 140 from the switch 90 and a second electrical connection 142 from the pump 80 are passed from the underside of the primary cover 100, through the electrical opening 110 to the outside, to be connected together and plugged in to an electrical supply. A grommet 144 is provided which seals the electrical opening 110 and which also seals itself around the electrical connections 140 and 142.

At this point, the primary cover 100 can be removably installed over the pump compartment 44, in the process of which the discharge pipe 86 is slidingly received into the extension 114 of the discharge opening 106. The primary cover 100 is affixed at the fastening points 104 to the perimeter 52 using the screws 102, following which the secondary cover is similarly put in place over the switch compartment 46, overlapping the protruding portion 116 of the primary cover 100.

An outflow pipe, not illustrated, is now threadedly engaged with the discharge plumbing port 106, to connect with a disposal means such as a sewer or septic system. Similarly, a vent pipe is threadedly engaged with the vent opening 108, to direct away fumes from the reservoir 12, which is now effectively sealed off from its immediate surroundings.

The unit 10 can be used and flushed normally like a conventional installation. With each use the level of waste rises in reservoir 12 and in the sump 40 in particular, causing the float 94 to rise and urge the connecting rod 92 upward. At the predetermined depth of waste, the float 94 has risen sufficiently for the connecting rod 92 to actuate the switch 90, powering the pump to eject the accumulated waste from the reservoir 12 through the discharge pipe 86, the outflow pipe 116, and finally into the disposal system. The switch 90 actuates again to turn off the power when the float 94 has fallen in response to the waste having receded to a predetermined minimum depth.

The torque stops 58 preclude any tendency of the pump 80 when operating to be displaced from its correct position. Vibration is inhibited by the engagement of the discharge pipe 86 with the extension 114 of the discharge opening 106, and also by the boss 112 which is configured to contact the pump 80 minimize any vertical movement. Clearance between the top of the switch 90 and the underside of the secondary cover 120 is minimized, so that the switch 90 cannot move upward in response to the rising float 94.

It has been noted that the inlet floor 24 has a flat portion 26 and raised portions 28 which slope downwardly to meet the sump floor 42. The sloping portions 28 are intended to provide that under gravity, sediment in the waste will migrate to the sump floor 42. The flat portion 26 of the inlet floor 24 is directly in the path of incoming waste, which is therefore effectively flushed towards the sump floor 42.

When the unit 10 malfunctions, it is necessary to open the sump 40 for inspection. Sometimes, the malfunction may be caused for example by a blockage or by the float sticking, and it may be simply corrected. In existing systems, it is necessary to disturb or disconnect plumbing, venting and electrical connections in order to remove a cover to allow the malfunction to be corrected. In the present invention, the secondary cover 120 is easily removable, it being necessary only to disengage the fasteners 122 from the fastening points 124 without interrupting plumbing, venting or electrical connections. If after inspection it is found necessary to remove the primary cover 100, it can be removed be disengaging the fasteners 102 from the fastening points 104, and the plumbing and electrical fixtures can be disengaged. However, if the malfunction is correctable after removal of only the secondary cover 120, the time, labor and wear-and-tear involved in removing the primary cover 100 will have been avoided.

The reservoir 12 is typically fabricated preferably from low density polyethylene, or alternatively from some other mouldable material such as fiberglass. The covers are preferably fabricated from polypropylene or other moldable material such as ABS.

While the invention has been described in connection with certain embodiments, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A housing for bathroom waste, comprising:

(a) a reservoir having a platform area including an inlet for receiving bathroom waste into the reservoir and a sump, the sump being open at its top and the sump opening being sized to receive a pump and a float mechanism therethrough;

(b) a primary cover attachable to the reservoir and configured to occlude a portion of the sump opening, the primary cover including one of a plumbing port, a venting port or an electrical supply port; and (c) a secondary cover attachable to the reservoir and configured to occlude a remaining portion of the sump opening, (d) the reservoir having torque stops including raised bosses sized and positioned to restrict pump movement during one of transportation of the housing and operation of the pump.

2. The housing of claim 1, wherein the primary cover includes an access port and the secondary cover is sized to occlude the access port.

3. The housing of claim 1, further comprising a curved wall that faces the pump and forms a bridge extending across the sump.

4. The housing of claim 1, wherein the primary cover includes a boss sized to contact the pump.

5. The housing of claim 1, wherein the secondary cover is free of plumbing ports, venting ports and electrical ports.

6. The housing of claim 1, wherein the reservoir is integrally molded.

7. The housing of claim 6, wherein the reservoir includes locating members sized to contact the pump or the float mechanism, the locating members including a shelf, a rib and a stop.

8. The housing of claim 6, wherein the reservoir includes strengthening studs beneath the platform area.

9. A housing for bathroom wastes comprising:

a) a reservoir having an inlet for bathroom wastes and a sump, the sump having an open top sized to receive a pump and a float mechanism therethrough;

b) a primary cover configured to occlude a portion of the sump open top, the primary cover including one of a plumbing port, a venting port or an electrical port;

c) a secondary cover configured to occlude a remaining portion of the sump open top; and d) the primary cover including a boss sized to contact the pump.

10. A housing for bathroom wastes as in claim 9 wherein the reservoir is integrally molded and has torque stops including raised bosses sized and positioned to restrict pump movement during one of transporting of the housing and operation of the pump.

11. A housing for bathroom wastes as in claim 9 wherein the reservoir is integrally molded and includes locating members sized to contact the pump or the float mechanism, the locating members including a shelf, a rib and a stop.

* * * * *